US005249536A

United States Patent [19]

Hattori et al.

[11] Patent Number: 5,249,536

[45] Date of Patent: Oct. 5, 1993

[54] EMBROIDERY SEWING MACHINE

[75] Inventors: Osamu Hattori, Kakamigahara; Masaru Eriguchi, Ichinomiya, both of Japan

[73] Assignee: Kabushikikaisha Barudan, Aichi, Japan

[21] Appl. No.: 865,840

[22] Filed: Apr. 9, 1992

[30] Foreign Application Priority Data

Jun. 17, 1991 [JP] Japan ..... 3-171697

[51] Int. Cl.[5] ..... D05B 57/30; D05B 65/02; D05C 7/00

[52] U.S. Cl. ..... 112/98; 112/184; 112/202; 112/292

[58] Field of Search ..... 112/285, 291, 292, 293, 112/294, 295, 296, 297, 298, 181, 184, 197, 201, 202, 98

[56] References Cited

U.S. PATENT DOCUMENTS 4,566,395 1/1986 Tummino ..... 112/286 X
5,125,351 6/1992 Prais et al. ..... 112/292
5,131,340 7/1992 Tajima et al. ..... 112/292

*Primary Examiner*—Peter Nerbun
*Attorney, Agent, or Firm*—Pollock, Vande Sande & Priddy

[57] ABSTRACT

A looper is rotated under a throat plate, a stitching needle moves up and down through a needle hole formed in the throat plate and thus a cloth on the throat plate is stitched. After the cloth has been stitched, the thread between the needle hole and the looper is brought to a thread holding means disposed aside by thread drawing pieces and is maintained at its position by the thread holding means. Accordingly, even when the thread at this position is cut over the thread holding means, the thread can remain extending from the looper.

4 Claims, 12 Drawing Sheets

EMBROIDERY SEWING MACHINE

BACKGROUND OF THE INVENTION

1. Field of the Invention

This invention relates to an embroidery sewing machine which is used for forming embroidered patterns on a cloth. More particularly, it relates to an apparatus to cut a thread, which is used to form the embroidery patterns, in the embroidery sewing machine.

2. Description of the Prior Art

There is a conventional embroidery sewing machine having a construction as shown in FIG. 15A. A needle 304 moves up and down through a cloth placed on a throat plate 301 and a needle hole 302 of the throat plate 301. A looper 303 rotates synchronously with the needle. As a result, the cloth is stitched with a thread payed out through a thread insertion hole 303*a* of the looper 303. After the cloth has been stitched, a moving knife 306 advances in the direction of an arrow 310*a* and returns in the direction of an arrow 310*b*. While the moving knife is returning, a thread 311 between the needle hole 302 and the looper 303 is hooked on a hook portion 307 of the moving knife 306 as shown in FIG. 15B and is drawn towards a counter knife 305. The drawn thread 311 enters a guide portion 309 of the moving knife 306 as shown in FIG. 15C and is then cut by an edge 308 of the moving knife 306 and an edge 312 of the counter knife 305.

However, when the thread 311 between the needle hole 302 and the looper 303 is cut in the above mentioned embroidery sewing machine, there is a possibility that such portion of the thread 311 as extending from the thread insertion hole 303*a* of the looper 303 could be pulled into the thread insertion hole 303*a* of the looper 303 due to its own weight or the tension given beforehand to it. If the thread is pulled in this manner, it is impossible to hook the thread on the needle in the next stitching cycle with the same looper. Consequently there appears a problem that an operator is compelled to perform a troublesome work to manually pull the thread 311 out of the thread insertion hole 303*a* of the looper 303.

Furthermore, when the thread is cut in the above mentioned manner, the thread 311 near the guide portion 309 is heavily inclined to the return direction 310*b* of the edge 308 as is evident from FIG. 15C. It is difficult for the edge 308 to cut the thread 311 under such condition and there is a problem that a smooth thread such as a non-twisted nylon thread is apt to fail to be cut. Moreover, if the thread 311 is thick, it pushes apart the moving knife 306 from the counter knife 305 in the direction of an arrow 313 in FIG. 15D when the thread enters between the guide portion 309 and the counter knife 305. Thus the edges 308 and 312 can not be fitted to each other and there is a further problem that the thread 311 happens to fail to be cut.

SUMMARY OF THE INVENTION

The present invention has been made in order to solve the above mentioned problems (technical subjects) in the prior art and its objects are as follows.

A first object of the present invention is to provide an embroidery sewing machine in which a cloth can be stitched with a thread supplied through a looper by a needle moving up and down and a rotating looper.

A second object of the present invention is to provide an embroidery sewing machine in which such portion of the thread as is located between the looper and the cloth can be held after the cloth has been stitched.

According to the present invention, a thread holding means is provided at the side of a space between the needle hole and the looper. Drawing pieces bring the thread in said space to the thread holding means, and is held by the thread holding means. When the thread is held in this manner, the thread can remain extending from the looper even if the thread between the needle hole and the looper is cut at a point thereof over the thread holding means. If the thread remains extending from the looper in this manner, the thread can be surely hooked on the needle moving up and down by the looper as it starts to rotate in the next stitching cycle. Accordingly, the next stitching cycle can be smoothly started.

A third object of the present invention is to provide an embroidery sewing machine in which when the thread held by the thread holding means is cut by a cutter, the cross angle between the direction of the thread and the advance direction of the edge of the cutter can be made larger.

As is mentioned above, according to the present invention, the thread is drawn to the thread holding means by the drawing pieces to be held by the thread holding means. While the thread is held, the upper end of the thread over the thread holding means is connected, through the needle hole, to the cloth on a throat plate and the lower end of the thread is held by the thread holding means. Namely, the thread is fixed both at the upper and lower ends thereof. The cutter cuts the thread with upper and lower ends thereof already fixed. Accordingly, the cutter need not cooperate with the manipulation i.e. the drawing or holding of the thread but has only to cut the thread. Therefore, the cross angle between the advance direction of the edge of the cutter and the direction of the thread can be freely made larger. If the cross angle is made larger, the thread is very easy to cut. As a result, there is an effect that either a smooth thread, a thin thread or a thick thread can be surely cut.

DESCRIPTION OF THE PREFERRED EMBODIMENTS

Figure 1:
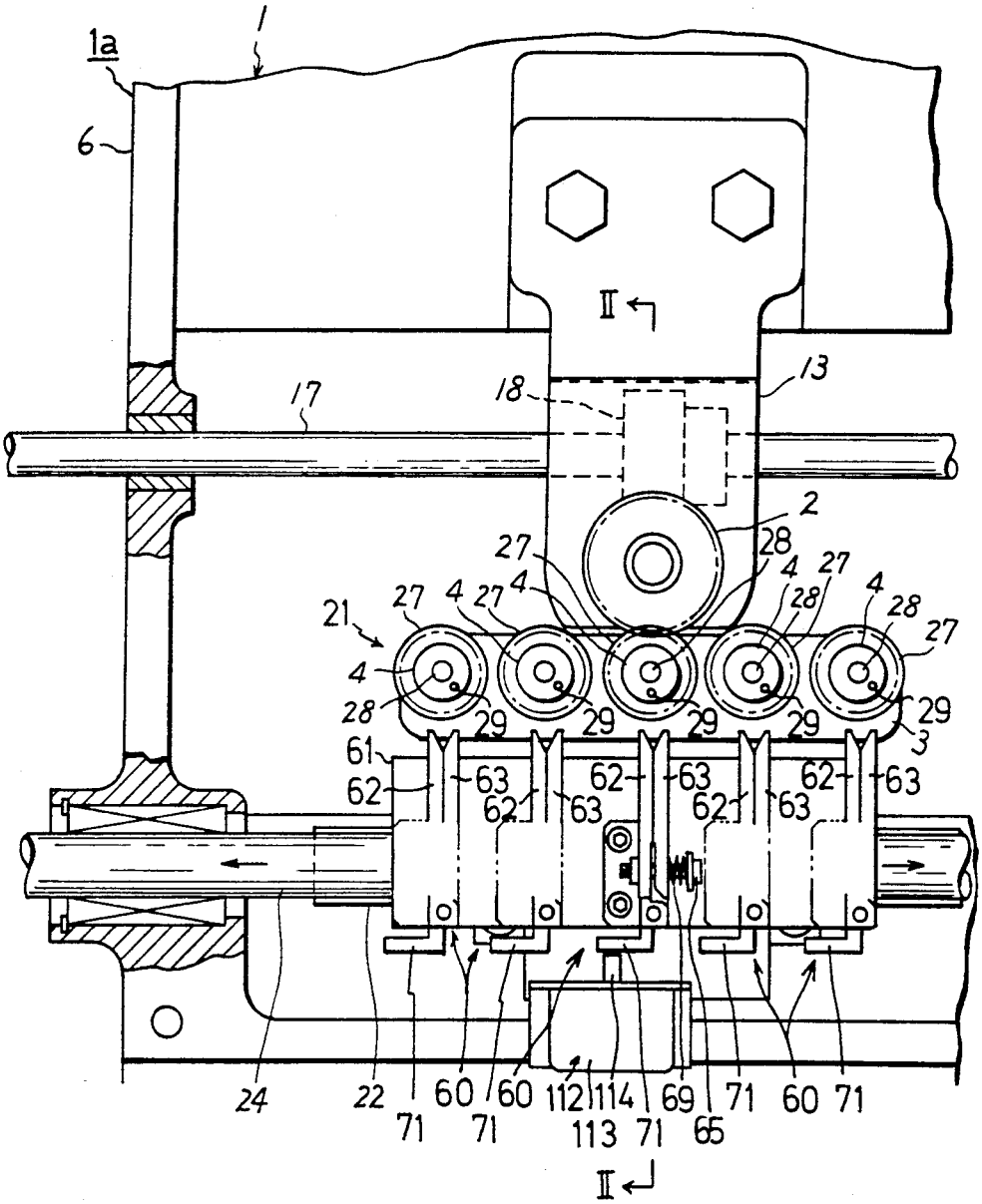
FIG. 1 is a plane view of a sewing machine bed with a top plate removed.
Figure 2:
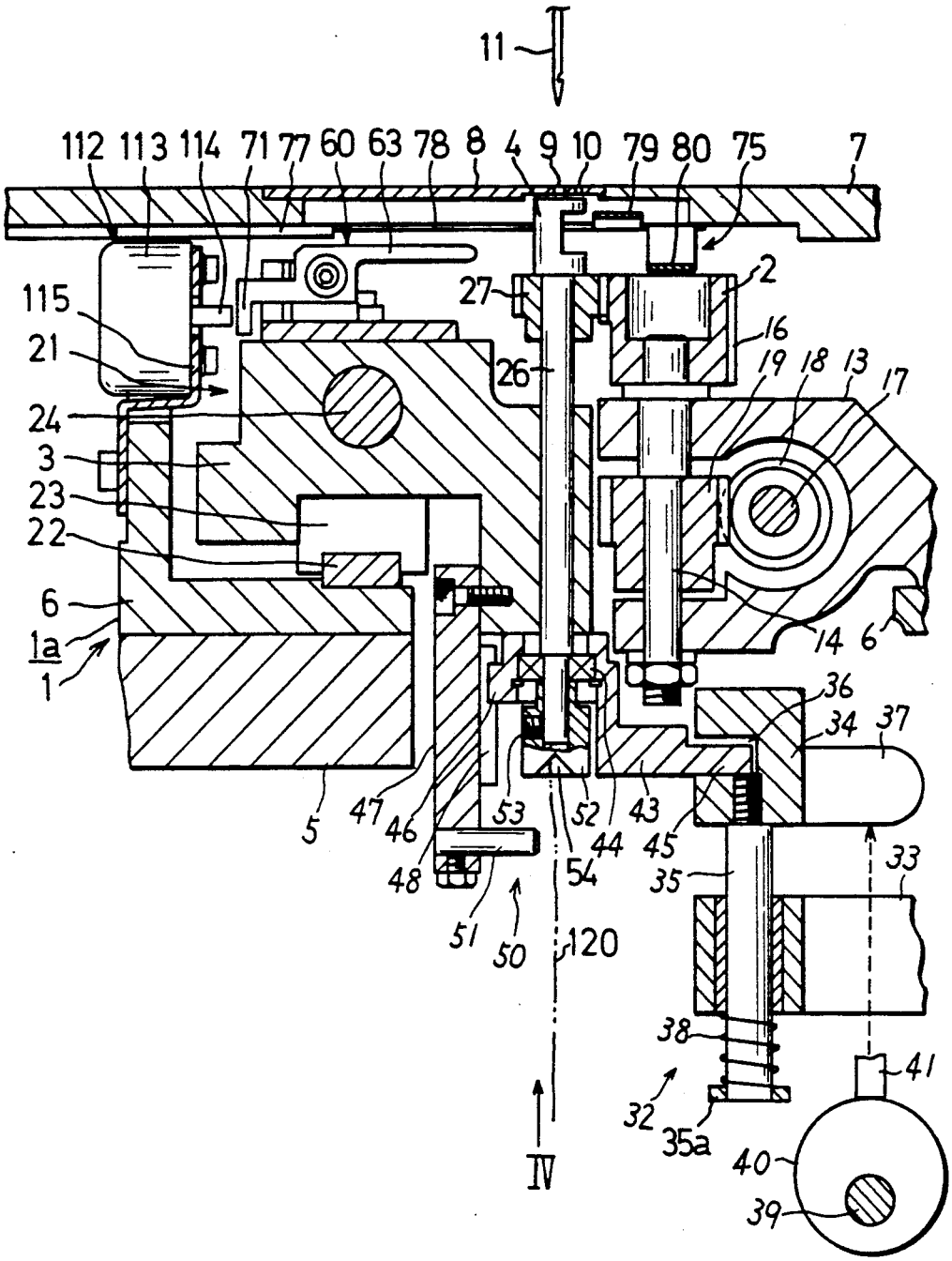
FIG. 2 is a section taken along line II—II in FIG. 1 (The top plate is shown but a thread cutting mechanism is omitted in order to avoid complexity.)

Embodiments of the present invention are explained in reference with drawings. A bed 1 of a multi-head embroidery sewing machine is shown in FIGS. 1 and 2. A plurality of beds 1 of this kind are arranged side by side in the lateral direction of FIG. 1. A sewing machine head is provided over each bed 1. In FIG. 2, a vertically movable stitching needle is shown by a numeral 11. The bed 1 is provided with plural loopers 4, a drive gear 2 to selectively drive one of them and other various mechanisms to be described hereinafter.

A bed frame 1*a* in the bed 1 consists of a frame body 6 secured to a sewing machine frame 5 in the multi-head embroidery sewing machine and of a top plate 7 put over the frame body 6. The top plate 7 is provided with a throat plate 8 as is well known. The throat plate 8 is formed with a needle hole 9 and a thread pulling up hole 10.

Figure 3:
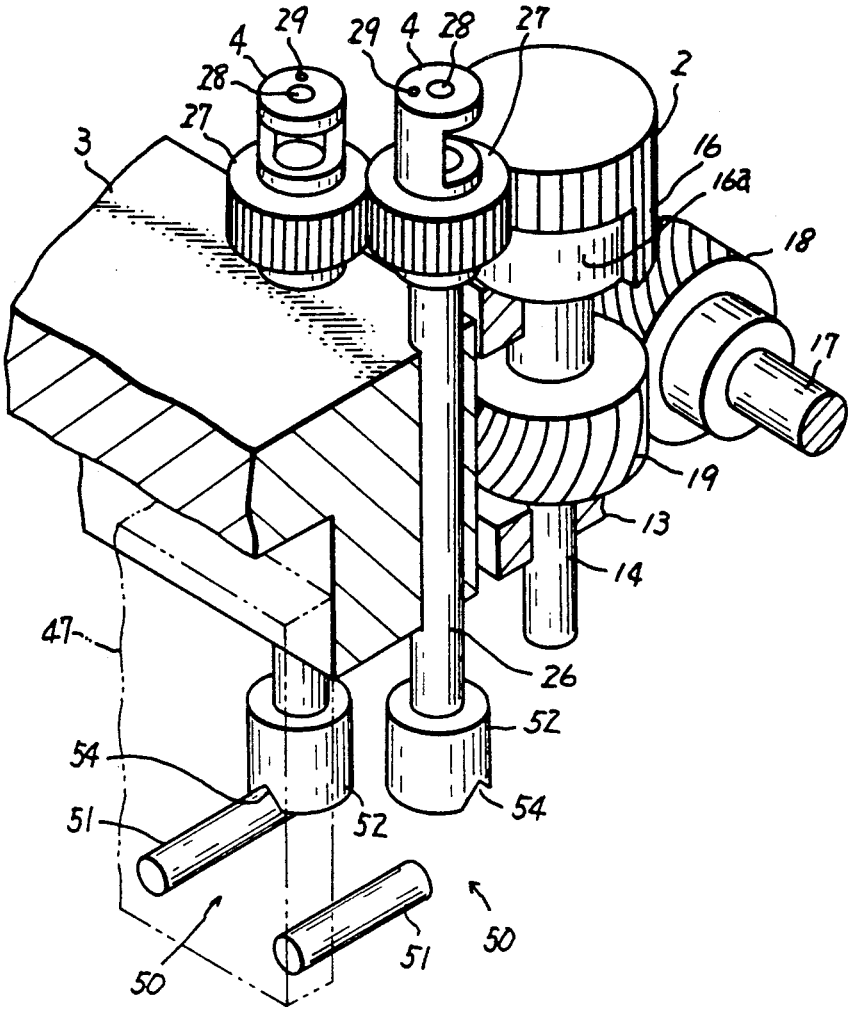
FIG. 3 is a perspective view in partial section showing a structure related to a drive gear and a looper.

Next, the drive gear 2 and a mechanism associated with it are explained. As shown in FIGS. 1 and 2, a support bracket 13 is secured to the frame body 6 and the drive gear 2 is mounted on the top end of a vertical drive shaft 14 mounted rotatably in the bracket 13. As shown in FIGS. 2 and 3, a guide gear 16 is made the same in diameter and pitch number as the drive gear 2 and is laid under the drive gear 2 so that every cog of the drive gear 2 may be continuous with each cog of the guide gear 16. In the present embodiment the guide gear 16 is formed integral with the drive gear 2. Both gears may be formed separately and then be separately secured on the drive shaft 14 in the above mentioned positional relationship between them. The guide gear 16 is formed with a partial cog-free portion 16*a* as shown in FIG. 3. The cog-free portion 16*a* is made so sufficiently long that the guide gear may be prevented from engaging a driven gear when the driven gear moves laterally as is described hereinafter. A horizontal main shaft 17 is provided through a lot of beds 1 and is rotatably supported by the frame body 6. To this main shaft 17 is connected, though not shown, a drive source to cause the main shaft 17 to rotate, for example, an electric motor. The main shaft 17 and the drive shaft 14 are adapted to cooperate by gears 18 and 19 secured on the shafts 17 and 14, respectively. Screw gears, for example, are used as the gears 18 and 19.

The aforementioned plural loopers 4 are prepared as component members of a looper assembly 21 as shown in FIGS. 1 and 2. The looper assembly 21 includes a movable frame 3. The frame body 6 is provided with a rail 22 and a slide member 23 is mounted on the frame body 6 for sliding movement on the rail 22 so that the movable frame 3 is adapted to move linearly in the lateral direction in FIG. 1. A horizontal laterally movable rod 24 is mounted through a lot of beds 1 and is supported by the frame body 6 for free right and left movement in the lateral direction in FIG. 1 (in the direction of its own axis). A drive means to laterally move the rod 24, though not shown, is connected to the laterally movable rod 24 and the movable frame 3 is adapted to move laterally as a result of the lateral movement of the rod 24. The movable frame 3 may be adapted to move laterally so that its locus of motion may be, for example, a horizontal circle. As shown in FIG. 2, a vertical hollow looper shaft 26 is mounted in the movable frame 3 for rotation and vertical linear movement. On the top end of the looper shaft 26 is attached the looper 4, under which a driven gear 27 is mounted on the shaft 26. The looper 4 is formed with a needle drop hole 28 and a thread insertion hole 29. The plural loopers 4 are positioned relative to the movable frame 3 at equal intervals in a direction parallel to the direction of movement of the movable frame 3. Accordingly, as a result of the lateral movement of the movable frame 3, each looper is adapted to be selectively located at a needle drop position i.e. a position where the needle drop hole 28 lies under the needle hole 9 in the throat plate 8. A linking member 43 formed with a linking piece 45 is mounted rotatably on the looper shaft 26 via a bearing 44. The linking member 43 is formed with a guide piece 46. A mount piece 47 secured to the movable frame 3 is provided with a guide member 48. The guide piece 46 is adapted to be guided to move in the vertical direction alone by the guide member 48 and to prevent the lateral swing of the aforementioned linking piece 45.

Figure 4:
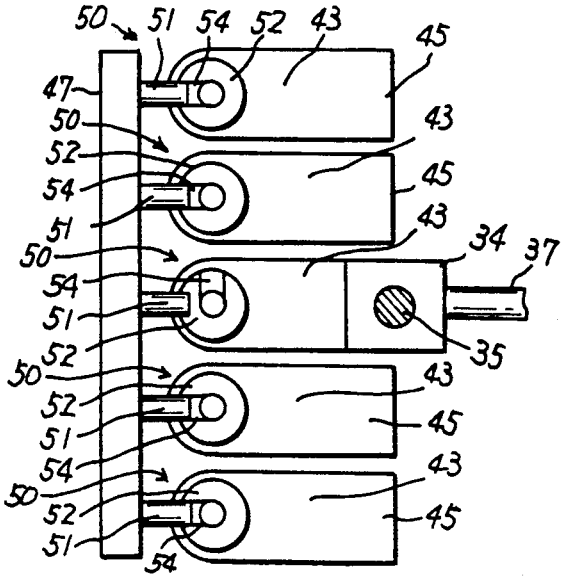
FIG. 4 is a view seen in the direction of an arrow IV in FIG. 2, showing a looper phase holding means.

As shown in FIGS. 2, 3 and 4, the looper assembly 21 includes a plurality of looper phase holding means 50 each of which is provided separately for each looper 4. In the present specification, the looper phase refers to the angular position of the looper 4. Each phase holding means 50 is provided with a turn stopper 51. The turn stopper 51 is made of a pin for example and is attached to the mount piece 47. A cam 52 is fixed on the lower portion of the looper shaft 26 by a setscrew 53. The cam 52 is formed, on a part of the lower surface thereof, with an engage depression 54 adapted to engage the turn stopper 51.

As shown in FIG. 1, the looper assembly 21 includes thread holding means 60 each of which is provided separately for each looper 4. Each thread holding means 60 includes a pair of seizing pieces 62 and 63. The seizing piece 62 is mounted on a base 61 secured on the movable frame 3. The seizing piece 63 is pivotally connected to the seizing piece 62 by a pin 64 and is adapted to seize a thread between itself and the seizing piece 62. An adjust screw 65 is screwed into a tapped hole 67 in the seizing piece 62 through a through hole 66 in the seizing piece 63 and a lock nut 68 is screwed on the end of the adjust screw 65. Between the edge of the through hole 66 and a spring seat 70 secured on the adjust screw 65 is inserted a compression coil spring 69 to close the seizing pieces 62 and 63 to each other and to cause them to seize the thread between them. The strength of the force to close a pair of seizing pieces 62 and 63 can be adjusted by turning the adjust screw 65. A release piece 71 to release the seized thread is formed integrally with the seizing piece 63.

Figure 9:
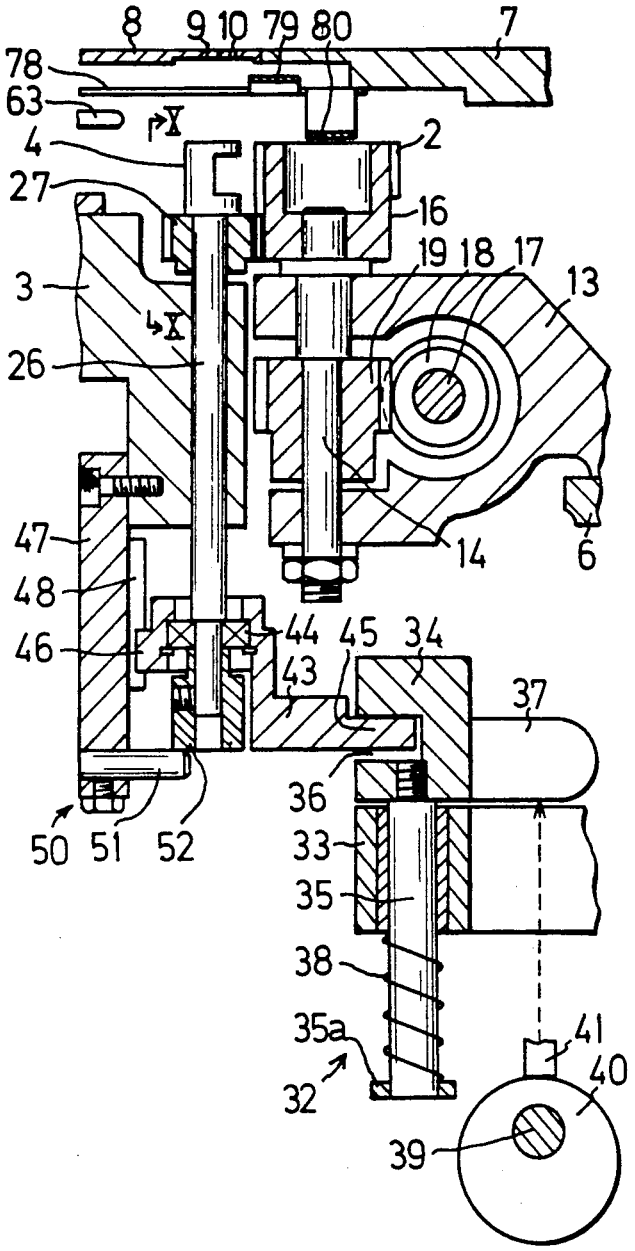
FIG. 9 is a view similar to FIG. 2 but showing the lowered looper.

Next, the bed 1 is provided with an elevating mechanism 32 to displace the looper 4 at the needle drop position in the direction of its axis as shown in FIGS. 2 and 9. The mechanism 32 includes a support bracket 33 secured to the sewing machine frame 5. An elevating member 34 is attached on the top of a guide rod 35 mounted, for vertical movement, in the bracket 33. The elevating member 34 is formed with a linking engage portion 36. The engage portion 36 is so formed that the linking piece 45 may freely enter or leave the portion 36 in the direction perpendicular to the page of FIG. 2 i.e. in the vertical direction of FIG. 4. A return spring 38 to bias the elevating member 34 downwards is inserted between the bracket 33 and a spring seat 35*a* attached on the end of the guide rod 35. The elevating member 34 is provided with a driven piece 37. A horizontal operating shaft 39 is provided through a lot of beds 1 and is adapted to be rotated back and forth by a drive mechanism not shown. An eccentric cam 40 is mounted on the operating shaft 39 and a transmitting piece 41 to drive the driven piece 37 via the cam 40 is interposed between the cam 40 and the driven piece 37. The elevating means 34 is adapted to move up and down due to the rotation of the cam 40 which is actuated by the operating shaft 39 and transmitted through the transmitting piece 41 and the driven piece 37. The above mentioned elevating mechanism may be one which is adapted to raise the looper shaft 26 of the looper 4 at the needle drop position directly, for example, by a solenoid.

Figure 5:
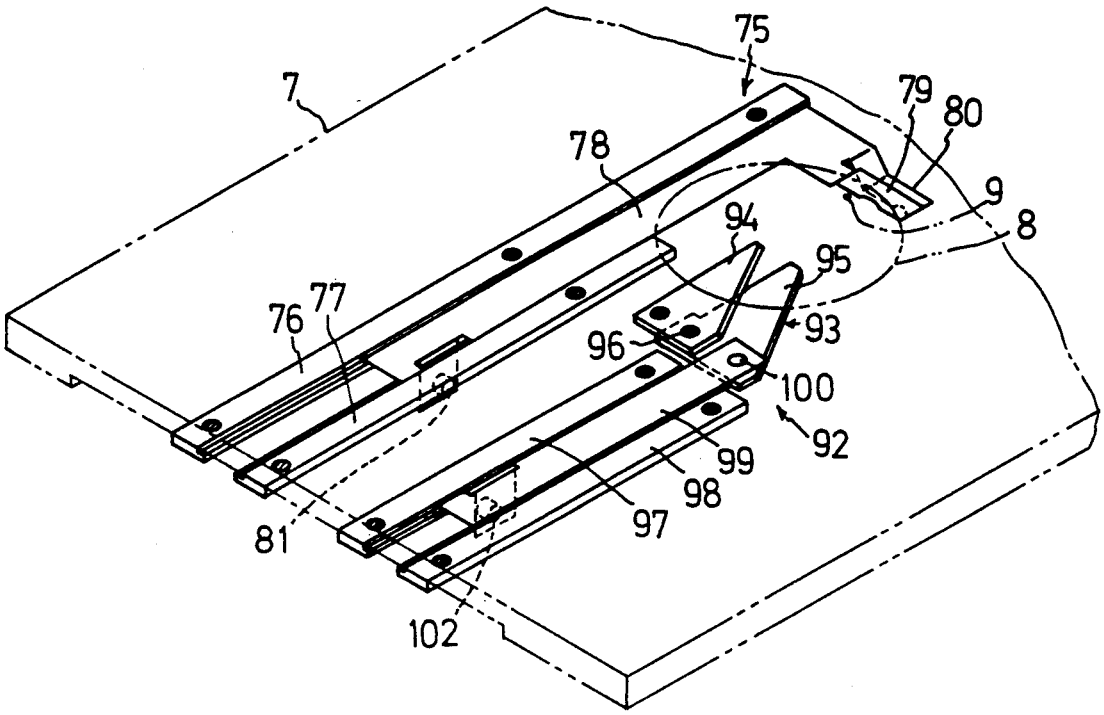
FIG. 5 is a perspective view showing a thread drawing mechanism and the thread cutting mechanism.
Figure 6A:
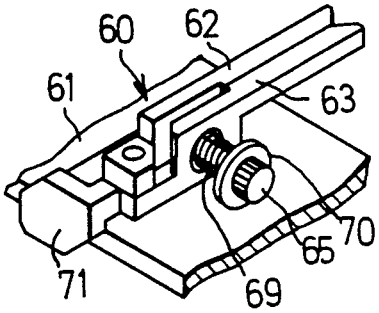
FIG. 6A is a perspective view of the thread holding means and FIG. 6B is a fragmentary perspective view.
Figure 6B:
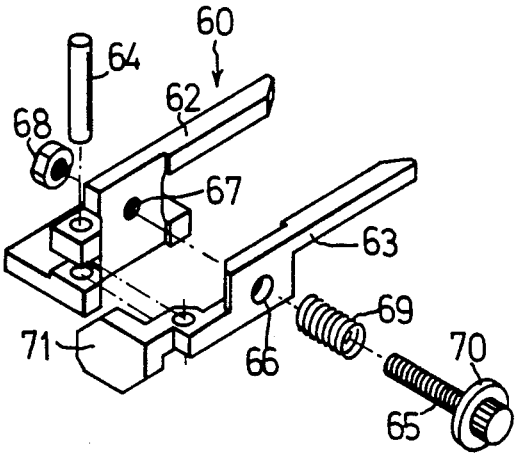

As shown in FIGS. 2, 5 and 12, the bed 1 includes a thread drawing mechanism 75. This mechanism 75 is one to draw the thread located between the needle hole 9 and the looper 4 at the needle drop position up to the thread holding means 60 associated with this looper 4. Guides 76 and 77 are provided on the lower surface of the top plate 7. A slider 78 is adapted to be guided by guides 76 and 77 and be movable back and forth. The slider 78 is formed integrally with a thread drawing member having an upper drawing piece 79 and a lower drawing piece 80. As shown in FIGS. 12B and 12D, the upper drawing piece 79 is adapted to be able to displace to a position over the seizing pieces 62 and 63 and the lower drawing piece 80 is adapted to be able to be displaced to a position under the seizing pieces 62 and 63. These drawing pieces 79 and 80 are formed respectively with depressions 79*a* and 80*a* for drawing the thread without causing it to slip laterally. The slider 78 is provided with a linking piece 81 for connection with a operating mechanism.

Figure 7:
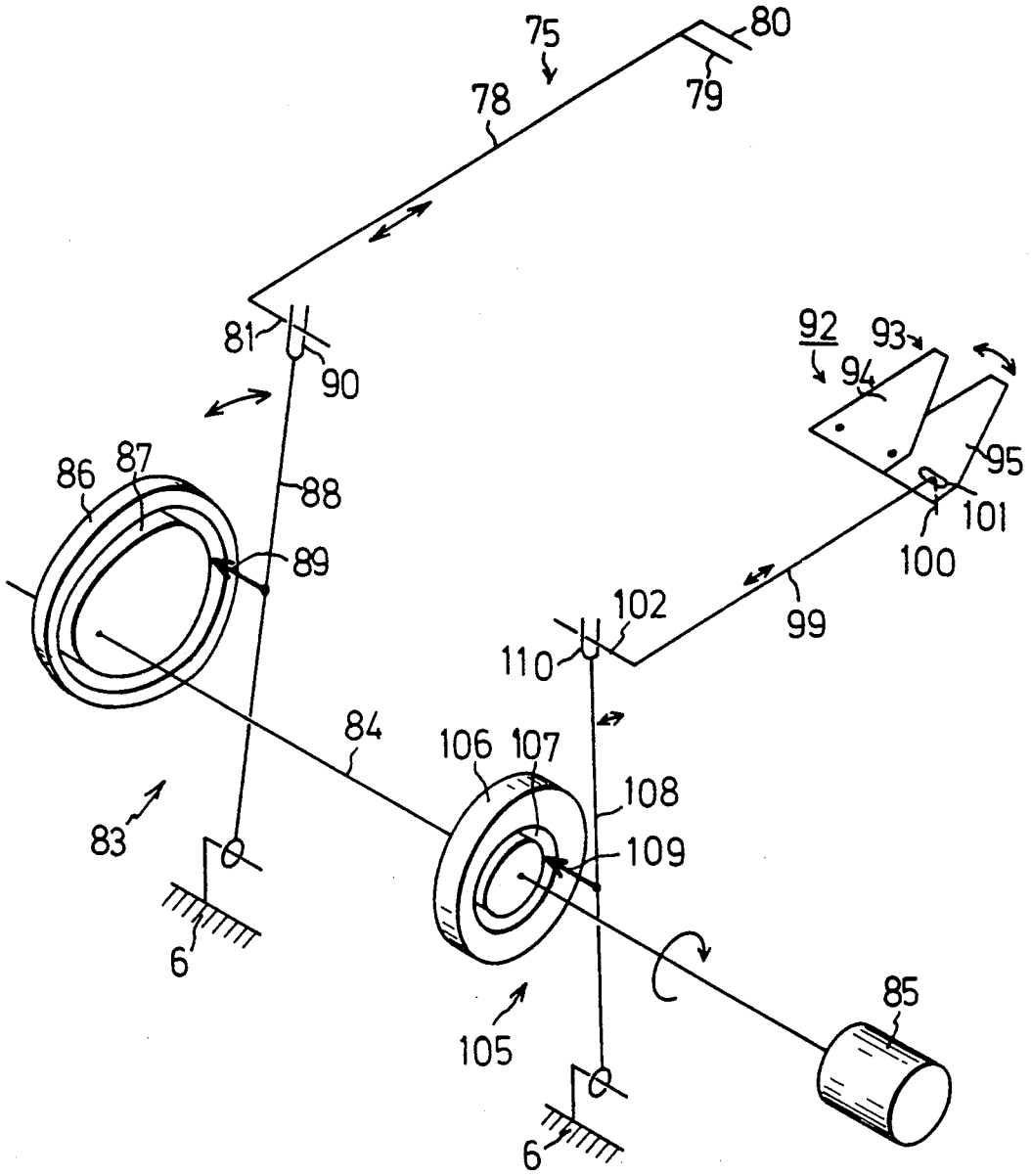
FIG. 7 is a schematic view of an operating mechanism for the thread drawing mechanism and an operating mechanism for the thread cutting mechanism.

An operating mechanism 83 for the thread drawing mechanism 75 is shown in FIG. 7. A horizontal operating shaft 84 is provided through a plurality of beds 1 and an operating electric motor 85 is connected to one end of the shaft 84. In each bed 1, a cam 86 is mounted on the operating shaft 84. A lever 88 is pivotally connected, at one end thereof, to the frame body 6. A follower 89 mounted on the intermediate portion of the lever 88 is adapted to engage a groove 87 in the cam 86. A linking member 90 provided at the other end of the lever 88 engages the linking piece 81. When the electric motor 85 rotates, the cam 86 is rotated and the lever 88 is swung in the direction shown by an associated arrow. As a result, the slider 78 and drawing pieces 79 and 80 move forth and back in the direction shown by an associated arrow in the figure.

Figure 12A:
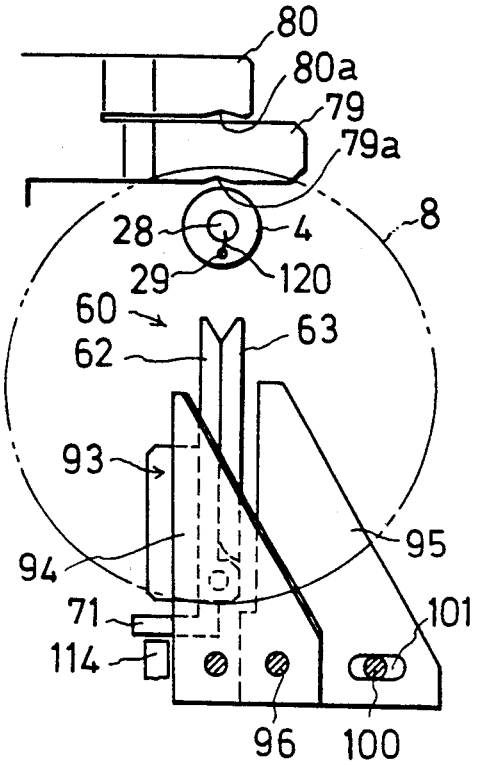
FIGS. 12A through 12D are views for explaining the operations of the thread drawing mechanism, the thread holding means and the thread cutting mechanism.
Figure 12C:
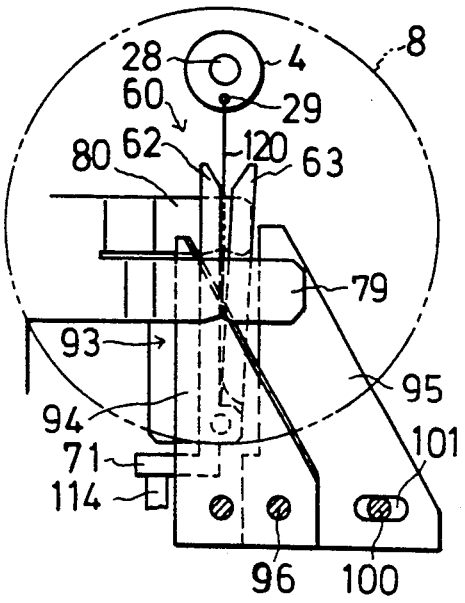
Figure 12B:
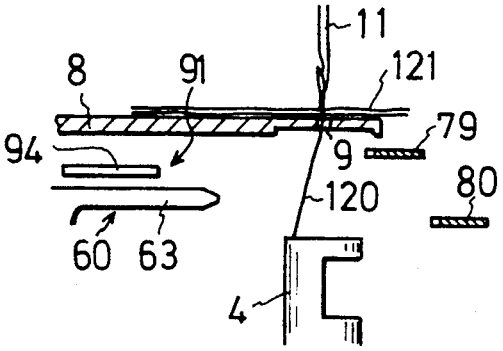

As shown in FIG. 12B, there is provided, over the thread holding means 60, a space 91 where the thread is cut and a thread cutting mechanism 92 as shown in FIG. 5 is disposed. A cutter 93 consisting of a pair of blades 94 and 95 is provided over the thread holding means 60 associated with the looper 4 at the needle drop position. The blade 94 is secured on the lower surface of the top plate 7 and the blade 95 is pivotally connected to the blade 94 by a pin 96. A pair of guides 97 and 98 are attached on the lower surface of the top plate 7. An operating piece 99 is adapted to be guided by the guides 97 and 98 and be able to move back and forth. The operating pieces 99 are provided, at one end thereof, with an engage piece 100, which in turn engages an elongate hole 101 formed in the movable blade 95. The operating piece 99 is provided, at the other end thereof, with a linking piece 102 for connection with a operating mechanism.

An operating mechanism 105 for the thread cutting mechanism 92 is shown in FIG. 7. The operating mechanism 105 is constructed similarly as the operating mechanism 83 for the aforementioned thread drawing mechanism 75 and includes a cam 106, a cam groove 107, a lever 108, a follower 109 and a linking member 110. When the aforementioned electric motor 85 rotates, the cam 106 is rotated and the lever 108 is swung in the direction shown by an associated arrow. Furthermore, the movable blade 95 is moved by the operating piece 99 in the direction shown by an associated arrow and the thread is cut by the cutter 93.

In the next place, as shown in FIGS. 1 and 2, the bed 1 includes a releasing mechanism 112 for the thread holding mechanism 60 in the aforementioned looper assembly 21. The mechanism 112 consists of a solenoid 113 mounted, via a bracket 115, on the frame body 6. A plunger 114 of the solenoid 113 faces the release piece 71 of the thread holding means 60 associated with the looper 4 at the needle drop position. When the solenoid 113 is energized, the plunger 114 protrudes. Then the plunger 114 pushes the release piece 71 to open the seizing pieces 62 and 63 from each other.

Now the operation of the above mentioned embroidery sewing machine is explained. In a normal stitching operation, the looper 4 at the needle drop position is elevated to a raised position by the elevating mechanism 32 as shown in FIG. 2 and the driven gear 27 of the looper 4 is in mesh with the drive gear 2. In this situation, the main shaft 17 is rotated back and forth and the looper 4 is rotated in a well known manner forth and back by the torque transmitted through the gears 18 and 19, the drive shaft 14, the drive gear 2 and the driven gear 27. As is well known, this rotation is performed synchronously with the vertical movement of the stitching needle 11. On the other hand, the cloth extended on an embroidery frame is moved in lateral directions on the top plate 7 intermittently and synchronously with the vertical movement of the needle 11. As a result, the cloth is stitched on the throat plate 8 with a thread 120 supplied through the thread insertion hole 29 of the looper 4.

Figure 12D:
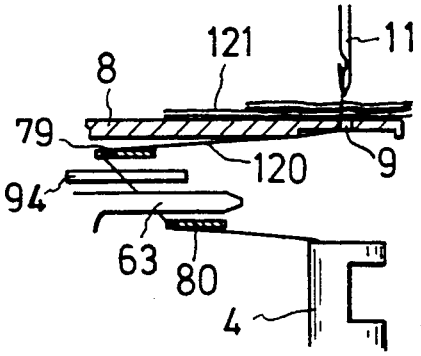
Figure 13A:
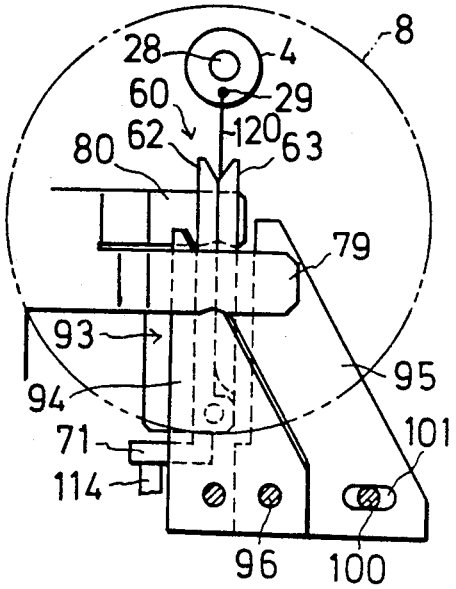
FIGS. 13A through 13D are views for explaining the operations of the thread drawing mechanism, the thread holding means and the thread cutting mechanism.
Figure 13C:
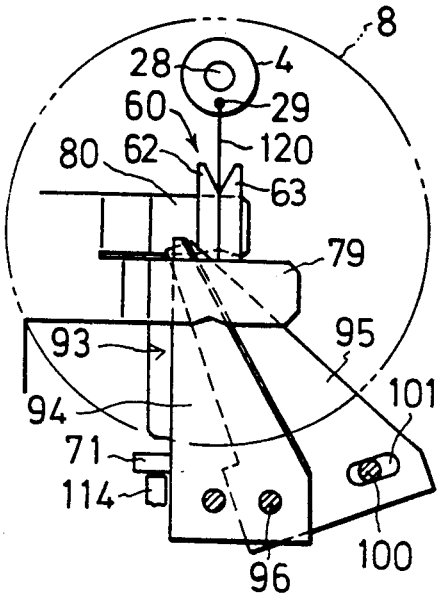
Figure 13D:
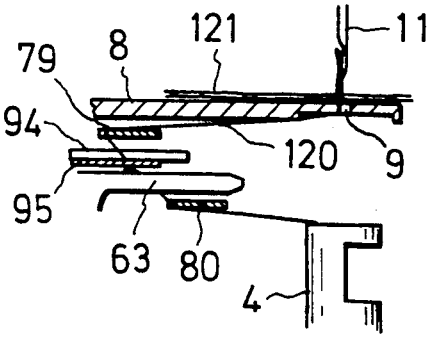
Figure 14:
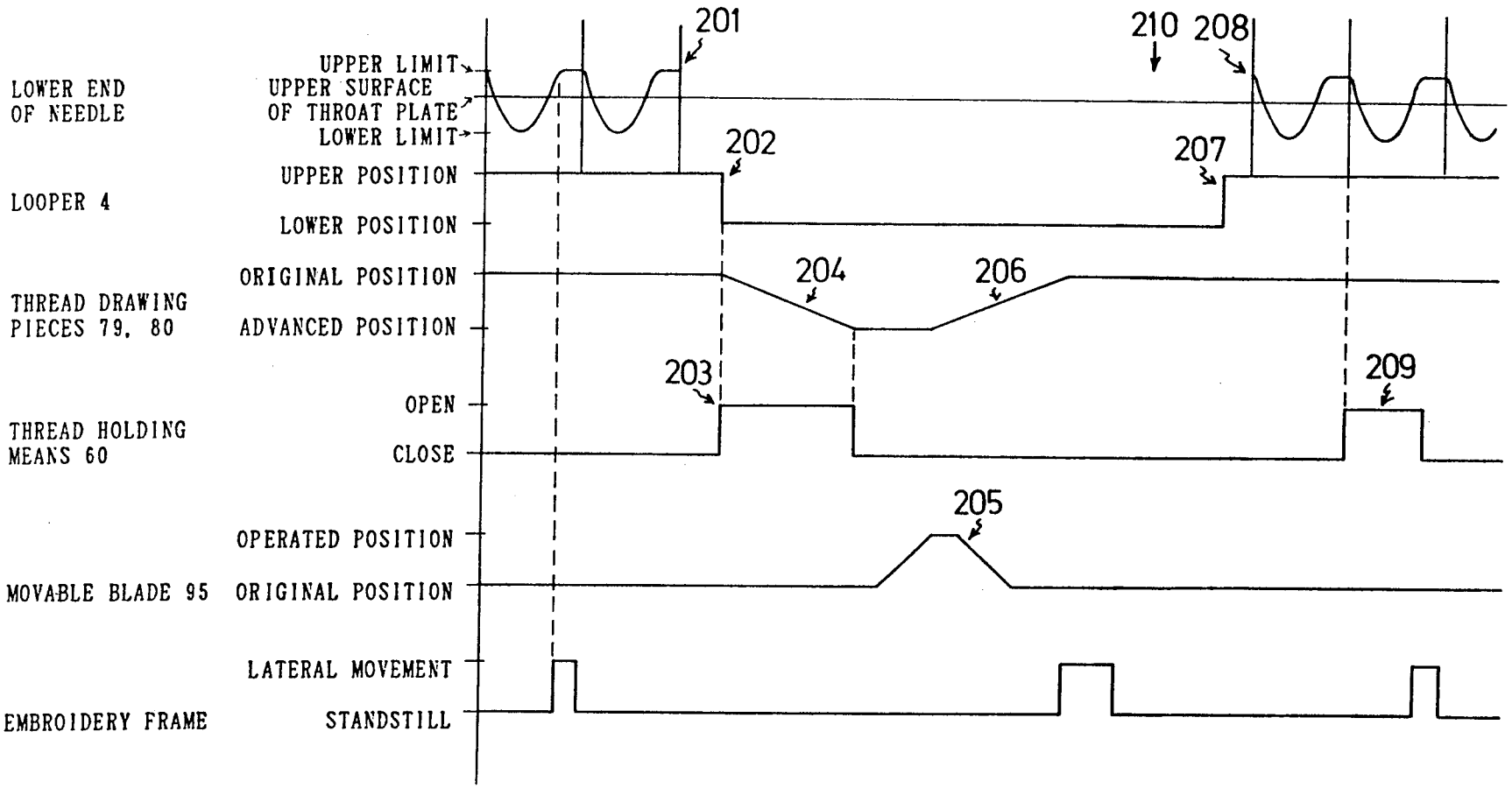
FIG. 14 is a time chart for explaining operations.
Figure 15A:
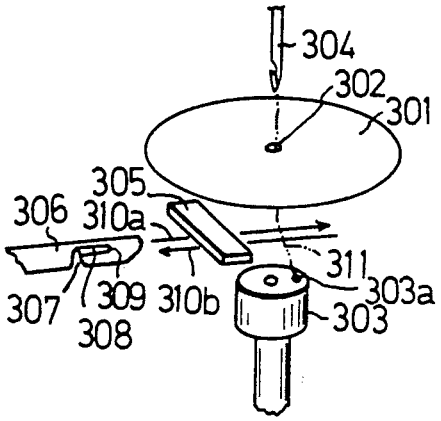
FIG. 15A PRIOR ART
FIG. 15A is a perspective view showing a prior art and FIGS. 15B through 15D are sections for explaining operations.
Figure 15C:
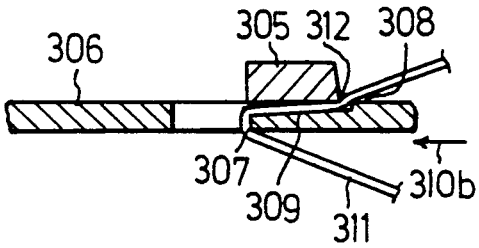
FIG. 15C PRIOR ART
Figure 15B:
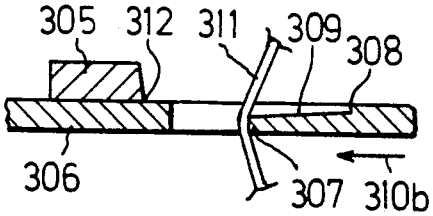
FIG. 15B PRIOR ART
Figure 15D:
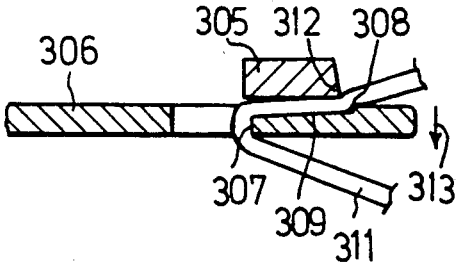
FIG. 15D PRIOR ART

In the next place, in reference with FIG. 14, a stitching operation is described which is performed to form a different embroidery pattern at a different place on the cloth after a previous embroidery pattern has been formed at a place on the cloth. As shown by a numeral 201 in FIG. 14, the vertical movement of the needle 11 is first stopped and the rotation of the main shaft 17 is stopped at the same time. In this case, the rotation of the looper 4 is stopped when the thread insertion hole 29 is at the 6 o'clock position of a clock as shown in FIG. 12A. Next the operating shaft 39 in the elevating mechanism 32 is rotated and the shaft 39 lowers the elevating member 34 via the cam 40, the transmitting piece 41 and the driven piece 37. As a result, the linking member 43 lowers the looper shaft 26 and the looper 4 is moved downwards from the path of reciprocation of the drawing pieces 79 and 80 to the lower position apart from the throat plate 8 (refer to a numeral 202 in FIG. 14). The seizing pieces 62 and 63 are opened by the releasing mechanism 112 as shown in FIG. 12C (refer to a numeral 203 in FIG. 14). Next the drawing pieces 79 and 80 advance towards the thread holding means 60 as shown in FIGS. 12C and 12D and bring the thread 120 between the needle hole 9 and the thread insertion hole 29 to between a pair of seizing pieces 62 and 63 and between a pair of blades 94 and 95 in the cutter 93 (refer to numeral 204 in FIG. 14). Next the seizing pieces 62 and 63 are closed as shown in FIGS. 13E and 13F and the thread 120 is held. Next the thread 120 is cut by the motion of the movable blade 95 as shown in FIGS. 13C and 13D (refer to a numeral 205 in FIG. 24). In the case of this cutting operation, the thread 120 between the cloth 121 and the seizing pieces 62 and 63 is secured, at one end thereof, to the cloth 121 and is seized, at the other end thereof, by the seizing pieces 62 and 63 to be secured between them. Namely, the thread 120 is subject to a certain tension and secured at both ends thereof. Accordingly, when the blade 95 moves, the thread 120 does not go in between the overlapping surfaces of the blades 94 and 95 without being cut but is surely cut by them.

Figure 13B:
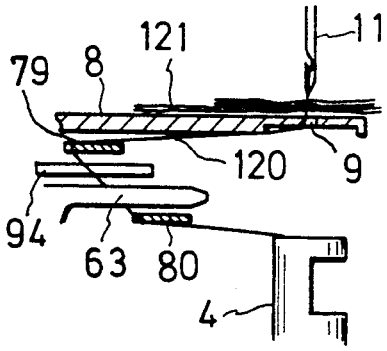

In the case of the above mentioned cutting operation, since the thread 120 has been drawn by both the upper and lower drawing pieces 79 and 80 as shown in FIG. 13B, the thread 120 makes a larger cross angle with the seizing pieces 62 and 63 and the blades 94 and 95. Accordingly, the thread 120 is held and cut surely. The thread 120 is brought to a position far away from the needle hole 9 by the upper drawing piece 79. Accordingly, after the thread 120 has been cut, such remaining portion of the thread as connected to the cloth 121 is long enough. It is, for example, from 45 to 50 mm long. When this thread 120 connected to the cloth i.e. the remaining thread at the end portion of one embroidery pattern is long, the work for binding each the remaining thread can be performed with ease, after all the embroidery patterns have been formed. After the thread is cut, the drawing pieces 79 and 80 are returned to the original positions (refer to a numeral 206 in FIG. 14).

Only one of the drawing pieces 79 and 80 may be used and the other may be omitted so long as the thread 120 between the needle hole 9 and the looper 4 can be brought into between a pair of seizing pieces 62 and 63 of the thread holding means 60 and between a pair of blades 94 and 95 of the cutter 93 by one of the drawing pieces 79 and 80. Only one of the drawing pieces may be adapted to advance towards between the thread holding means 60 and the cutter 93. The thread 120 may be cut manually with scissors in the space 91.

After the thread has been cut in the above mentioned manner, the embroidery frame is laterally moved and a place for the next embroidery pattern on the cloth is brought onto the needle hole 9. When the embroidery frame is laterally moved, the thread which is cut but remains connected to the cloth slips out from the needle hole 9. Next the looper 4 is again raised to the upper position as shown in FIG. 2 (refer to a numeral 207 in FIG. 14). The main shaft 17 begins to be rotated at the same time when the needle 11 begins to be vertically moved (refer to a numeral 208 in FIG. 14) and the different embroidery pattern begins to be formed. In the case of this start of this stitching cycle, the tip of the thread is seized by the seizing pieces 62 and 63. Accordingly, when the needle 11 drops into the needle drop hole 28 of the looper 4 and the looper 4 is rotated, the thread supplied through the thread insertion hole 29 of the looper 4 is surely hooked on the hook portion of the needle 11. Accordingly, the thread can be tightly stitched on the cloth and surely held in the cloth. The tip of the thread is released from being seized as shown by a numeral 209 in FIG. 14 after the thread has been surely held in the cloth at the start of the stitching cycle.

Figure 11A:
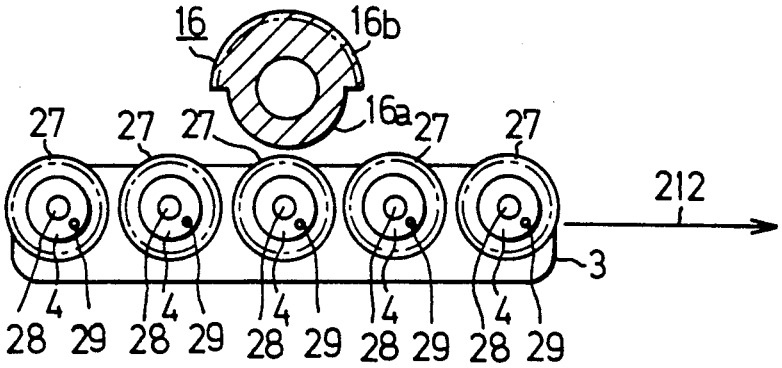
FIGS. 11A and 11B are horizontal sections showing the relationship between a driven gear and a guide gear when loopers are exchanged.

In the next place, the exchange of loopers for the change of threads is explained. In this case, an operation quite same as that in the above mentioned case is performed up to a time shown by a numeral 210 in FIG. 14. When the operation up to this time is finished, the driven gear 27 of the looper shaft 26 is in mesh with the cog portion **16*b* of the guide gear 16 as shown in FIG. 8A and the cam 52 rests on the turn stopper 51. Next the guide gear 16 in this state is rotated by the main shaft 17 in the direction of an arrow X. During the process of the rotation of the guide gear 16, while the driven gear 27 is in mesh with the cog portion 16*b* of the guide gear 16 as shown in FIG. 8A, the driven gear 27 is rotated in gear with the guide gear 16 turned in the direction of the arrow X. When the driven gear 27 comes from the cog portion 16*b* to the cog-free portion 16*a* of the guide gear 16 as shown in FIG. 8B, then the driven gear 27 stops. When the gear 27 stops, the turn stopper 51 fits into the engage depression 54 of the cam 52. As a result, the rotational phase of the looper 4 is maintained which is established when the driven gear 27 comes off the cog portion 16*b* of the guide gear 16. The thread insertion hole 29 of the looper 4 is maintained, for example, at half past 4 o'clock position of a clock as shown in FIG. 11. In order that such a phase is established, the cam 52 is beforehand adjusted to an angular position relative to the driven gear 27 with the screw 53 loosened and is secured at this position on the looper shaft 26 by the screw 53**.

Figure 8C:
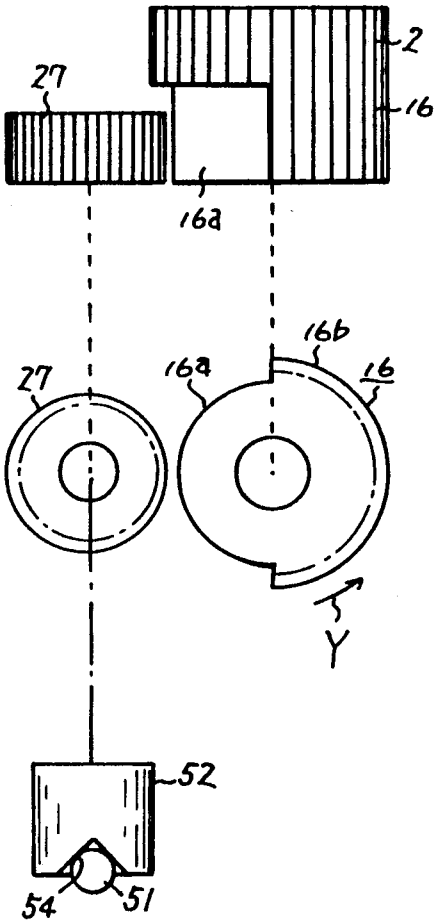
FIGS. 8A, 8B and 8C are views for explaining the order of looper exchanging operation.
Figure 8B:
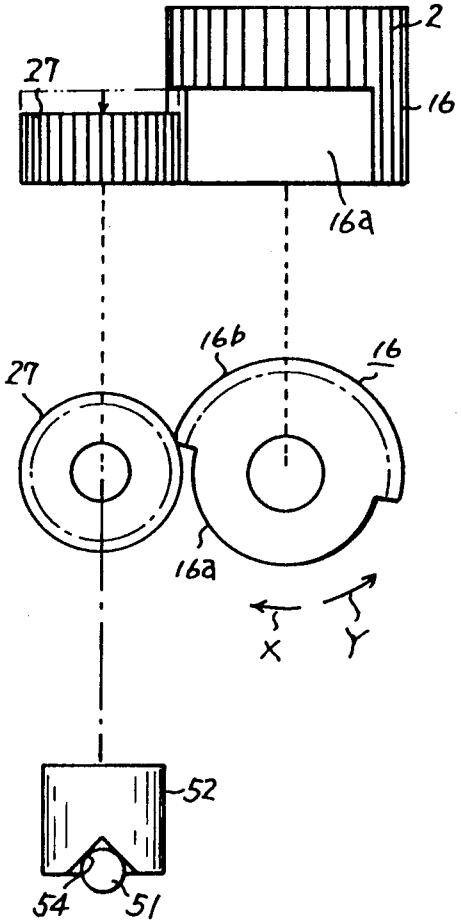
Figure 8A:
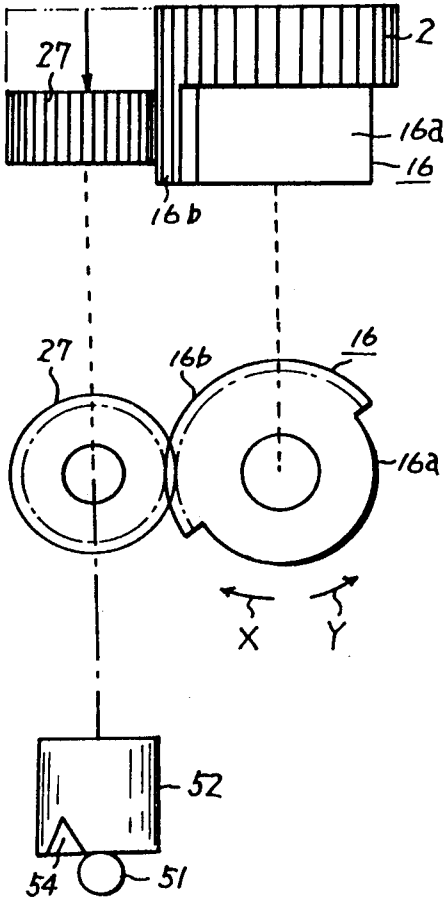
Figure 10:
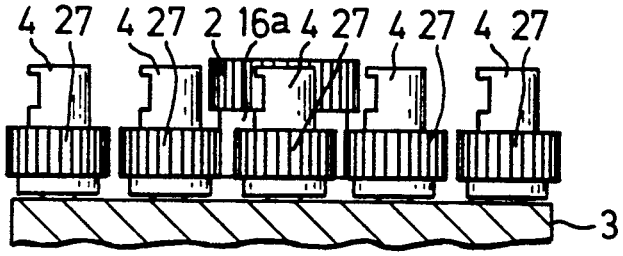
FIG. 10 is a section taken along line X—X in FIG. 9.
Figure 11B:
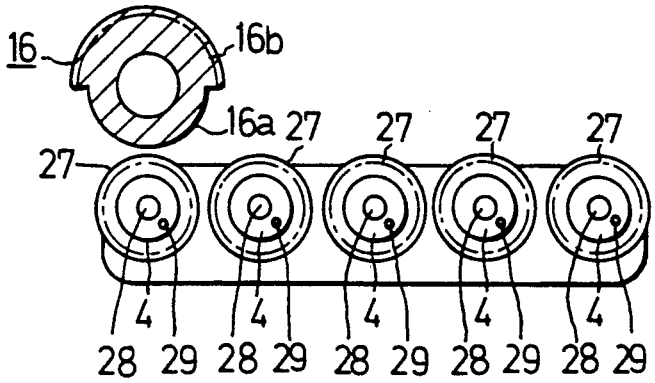

The guide gear 16 is continuously rotated in the direction of the arrow X as shown in FIG. 8C and the driven gear 27 comes to the cog-free portion **16*a* of the guide gear 16. Then the movable frame 3 is laterally moved by the laterally movable rod 24, for example, in the direction of an arrow 212 in FIG. 11. At this time all the driven gears 27 are laterally moved through the cog-free portion 16*a* as shown in FIGS. 10 and 11 and so the looper 4 is not rotated at all of course. Accordingly, the movable frame 3 can be laterally moved by a weak force which is sufficient to shift only the weight of the movable frame 3 together with loopers 4. As a result of the lateral movement of the movable frame 3, a subsequent looper 4 (in which a thread different in kind and color from that in the previously operated looper is beforehand charged) is brought to the needle drop position as shown in FIG. 11B. The angular position of this new looper 4 is maintained as well to be a prescribed position by the looper phase holding means 50** in the manner just described.

When the new looper 4 comes to the needle drop position, the guide gear 16 is rotated by the rotating main shaft 17 in the direction of an arrow Y in FIG. 8C. Moreover, when the cog portion **16*b* of the guide gear 16 comes to a position as shown in FIG. 8B, the driven gear 27 comes into mesh with the cog portion 16*b* of the guide gear and begins to be rotated. As the driven gear 27 is rotated, the cam 52 is rotated. Then the cam 52 runs on the turn stopper 51, the engage depression 54 comes out of the turn stopper 51 and a situation as shown in FIG. 8A is established. In this case, as is clear from the above explanation, the driven gear 27 is maintained, by the looper phase holding mechanism 50, at an angular position where the gear 27 has come out of the cog portion 16***b*. Accordingly, the cog portion 16*b* begins to be in mesh with the driven gear 27 very smoothly without causing the cogs thereof to collide with those of the driven gear 27. When the driven gear 27 comes in mesh with the cog portion 16*b* of the guide gear 16 in the manner just described, the elevating member 34 is raised by the rotating operating shaft 39 of the elevating mechanism 32 and the looper shaft 26 is raised by the elevating member 34 via the linking member 43. As a result, the driven gear 27 is guided by the cogs of the guide gear 16 and reaches the drive gear 2 and the looper 4 is moved to the place for stitching operation as shown in FIG. 2. Thereafter, the operation after the time shown by the numeral 210 in FIG. 14 is performed in the same manner as in the previously mentioned case.

As is described above, the present invention achieves the aforementioned objects thereof and has an effect that the cloth can be stitched and the thread can be seized and cut surely after the stitching cycle.

What is claimed is:

1. An embroidery sewing machine comprising a throat plate formed with a needle hole, a rotatable looper disposed under said needle hole for paying out a thread, said looper being movable up and down between an upper position close to the throat plate and a lower position apart from the throat plate, and a stitching needle adapted to move up and down through said needle hole, wherein said embroidery sewing machine further comprises a thread holding means provided adjacent said needle hole and said looper, defining a space therebetween, and adapted to hold and release said thread, said holding means supporting said thread in a space between said needle hole and said holding means, and a thread drawing member adapted to move to and from said thread holding means through said space between said needle hole and looper to bring said thread to said thread holding means where said thread is cut between said needle hole and said thread holding means.

2. An embroidery sewing machine as set forth in claim 1 further comprising a cutter adapter to cut said thread disposed in said space between said needle hole and said thread holding means.

3. An embroidery sewing machine as set forth in claim 2 wherein said thread drawing member comprises an upper drawing piece displaceable to a position over said cutter, and a lower drawing piece displaceable to a position under said thread holding means.

4. An embroidery sewing machine comprising:

a bed frame;

a laterally movable frame mounted on said bed frame supporting a plurality of loopers, said plurality of loopers being supported for rotation on a plurality of shafts, all of said loopers and shafts being laterally positionable by said movable frame so that one looper is positioned at a needle drop position, and being positionable vertically in said needle drop position, each shaft supporting a driven gear which rotates a respective looper;

means for vertically displacing a looper positioned in said needle drop position; and, a rotatable drive gear supported on said bed frame, connected to a rotatable guide gear, positioned to mesh with a driven gear, said guide gear and drive gear having continuous cogs of the same diameter and pitch, a portion of said guide gear being cog free, permitting said driven gear to be laterally displaced by said movable frame when another looper is being positioned in said needle drop position, said rotatable guide gear guiding a driven gear into meshing relationship with said drive gear when a looper in said needle drop position is vertically displaced.

* * * * *